US008591061B2

(12) United States Patent
Hyun et al.

(10) Patent No.: US 8,591,061 B2
(45) Date of Patent: Nov. 26, 2013

(54) LED LIGHTING APPARATUS INCLUDING REFLECTOR

(75) Inventors: Ji Yeon Hyun, Seoul (KR); Kyung-il Kong, Seoul (KR); Seok Jin Kang, Seoul (KR); Eunhwa Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/458,403

(22) Filed: Apr. 27, 2012

(65) Prior Publication Data

US 2012/0212957 A1 Aug. 23, 2012

Related U.S. Application Data

(63) Continuation of application No. 13/040,418, filed on Mar. 4, 2011, now Pat. No. 8,192,049.

(30) Foreign Application Priority Data

Apr. 10, 2010 (KR) ..... 10-2010-0033014

(51) Int. Cl.
*F21V 1/02* (2006.01)

(52) U.S. Cl.
USPC ..... 362/236; 362/241; 362/249.02; 362/298; 362/294; 362/373

(58) Field of Classification Search
USPC ..... 362/612, 613, 555, 511, 545, 236, 241, 362/20, 249.02, 249.06, 298, 294, 373, 455, 362/456
See application file for complete search history.

(56) References Cited

U.S. PATENT DOCUMENTS

| | | | | | |
|---|---|---|---|---|---|
| 145,200 | A | * | 12/1873 | Hyatt | 362/456 |
| 959,387 | A | * | 5/1910 | Richmond | 362/456 |
| 973,568 | A | * | 10/1910 | Russell | 362/456 |
| 1,540,781 | A | * | 6/1925 | Keuffel | 362/455 |
| 2,286,085 | A | * | 6/1942 | Haggart, Jr. | 362/455 |
| 3,853,088 | A | * | 12/1974 | Marko | 116/286 |
| 4,915,478 | A | | 4/1990 | Lenko et al. | |
| 4,929,866 | A | * | 5/1990 | Murata et al. | 313/500 |
| 4,989,122 | A | * | 1/1991 | Allekotte et al. | 362/97.1 |
| 5,136,483 | A | * | 8/1992 | Schoniger et al. | 362/545 |
| 5,365,411 | A | * | 11/1994 | Rycroft et al. | 362/20 |
| 5,418,384 | A | | 5/1995 | Yamana et al. | |

(Continued)

FOREIGN PATENT DOCUMENTS

| | | |
|---|---|---|
| CN | 201028327 Y | 2/2008 |
| DE | 10 2006 048 571 | 10/2006 |

(Continued)

OTHER PUBLICATIONS

Korean Office Action dated Aug. 31, 2011 for Application 10-2010-0033014.

(Continued)

*Primary Examiner* — Ismael Negron
(74) *Attorney, Agent, or Firm* — KED & Associates LLP

(57) ABSTRACT

The lighting apparatus includes a body including a recess which is defined by an inner wall; a reflector which is disposed within the recess of the body and faces the inner wall of the body, and includes a reflective surface reflecting light to the outside of the recess of the body; and a light source which is disposed within the recess of the body and emits light toward the reflective surface of the reflector.

20 Claims, 15 Drawing Sheets

(56) References Cited

U.S. PATENT DOCUMENTS

| | | | | |
|---|---|---|---|---|
| 5,453,855 | A | 9/1995 | Nakamura et al. | |
| 5,769,532 | A | 6/1998 | Saski | |
| 5,988,833 | A * | 11/1999 | Giese et al. | 362/455 |
| 6,026,602 | A | 2/2000 | Grondal et al. | |
| 6,966,684 | B2 * | 11/2005 | Sommers et al. | 362/604 |
| 6,969,180 | B2 * | 11/2005 | Waters | 362/293 |
| 6,988,815 | B1 * | 1/2006 | Rizkin et al. | 362/245 |
| 7,018,077 | B2 * | 3/2006 | Mullen | 362/455 |
| 7,059,754 | B2 | 6/2006 | Lekson et al. | |
| 7,101,058 | B2 | 9/2006 | Prell et al. | |
| 7,237,927 | B2 * | 7/2007 | Coushaine et al. | 362/554 |
| 7,284,874 | B2 | 10/2007 | Jeong et al. | |
| 7,452,109 | B2 | 11/2008 | Noh et al. | |
| 7,461,951 | B2 | 12/2008 | Chou et al. | |
| 7,473,019 | B2 * | 1/2009 | Laski | 362/612 |
| 7,591,578 | B2 * | 9/2009 | Chang | 362/612 |
| 7,670,034 | B2 | 3/2010 | Zhang et al. | |
| 7,824,077 | B2 | 11/2010 | Chen et al. | |
| 7,891,840 | B1 * | 2/2011 | Kang et al. | 362/249.02 |
| 7,963,689 | B2 * | 6/2011 | Lee | 362/624 |
| 8,029,164 | B2 | 10/2011 | Livesay et al. | |
| 8,215,801 | B2 | 7/2012 | Kong et al. | |
| 2001/0007527 | A1 | 7/2001 | Lammers et al. | |
| 2005/0185409 | A1 | 8/2005 | Mayer | |
| 2005/0281048 | A1 | 12/2005 | Coushaine et al. | |
| 2007/0171626 | A1 | 7/2007 | Chang | |
| 2007/0171676 | A1 | 7/2007 | Chang | |
| 2007/0230172 | A1 | 10/2007 | Wang | |
| 2008/0165307 | A1 | 7/2008 | Adachi et al. | |
| 2008/0175003 | A1 | 7/2008 | Tsou et al. | |
| 2008/0210953 | A1 * | 9/2008 | Ladstatter et al. | 257/88 |
| 2008/0285305 | A1 | 11/2008 | Fujino et al. | |
| 2009/0154167 | A1 | 6/2009 | Lin | |
| 2010/0067248 | A1 | 3/2010 | Frey et al. | |
| 2010/0135010 | A1 * | 6/2010 | Liu | 362/231 |
| 2010/0177508 | A1 | 7/2010 | Maglica | |
| 2010/0226147 | A1 * | 9/2010 | Chiang et al. | 362/628 |
| 2011/0075432 | A1 | 3/2011 | Chou et al. | |
| 2011/0228550 | A1 | 9/2011 | Robinson | |

FOREIGN PATENT DOCUMENTS

| | | | | |
|---|---|---|---|---|
| DE | 20 2009 016 455 | U1 | 12/2009 | |
| EP | 0 416 253 | | 3/1991 | |
| EP | 1 466 807 | | 10/2004 | |
| EP | 1 607 677 | | 12/2005 | |
| EP | 1 826 474 | | 8/2007 | |
| EP | 1826474 | A1 * | 8/2007 | G03B 21/20 |
| EP | 1 944 541 | | 7/2008 | |
| GB | 2 401 675 | | 3/2006 | |
| JP | 2000-268604 | | 9/2000 | |
| JP | 2005-038771 | | 2/2005 | |
| JP | 2006-106212 | | 4/2006 | |
| JP | 2009-117328 | | 5/2009 | |
| KR | 10-2003-0093726 | | 12/2003 | |
| KR | 10-2005-0089074 | | 9/2005 | |
| KR | 10-2006-0036039 | | 4/2006 | |
| KR | 10-0731454 | | 6/2007 | |
| KR | 10-2008-0012773 | | 2/2008 | |
| KR | 10-2008-0073596 | | 8/2008 | |
| KR | 10-2008-0098762 | | 11/2008 | |
| KR | 10-2009-0020181 | | 2/2009 | |
| KR | 10-2009-0124643 | | 12/2009 | |
| KR | 10-2010-0092856 | | 8/2010 | |
| KR | 10-2010-0117440 | | 11/2010 | |
| WO | Wo 03/062700 | A1 | 7/2003 | |
| WO | WO 2005/055328 | | 6/2005 | |
| WO | WO 2010/004794 | | 1/2010 | |

OTHER PUBLICATIONS

European Search Report dated Oct. 11, 2011 for Application No. 11150560.8.

Office Action dated Nov. 18, 2011 for U.S. Appl. No. 12/963,981.

Korean Notice of Allowance dated Jan. 16, 2012 for Application 10-2010-0033013.

Office Action dated Jun. 27, 2011 for U.S. Appl. No. 13/040,418.

Final Office Action dated Oct. 17, 2011 for U.S. Appl. No. 13/040,418.

Office Action dated Sep. 5, 2012 for U.S. Appl. No. 13/528,469.

Chinese Office Action dated Mar. 1, 2013 for Application 201110090413.X.

Chinese Office Action dated Jan. 1, 2013 for Application 201110090422.9 and English language translation.

European Search Report dated Feb. 27, 2013 for Application 13151023.2.

* cited by examiner

LED LIGHTING APPARATUS INCLUDING REFLECTOR

This application is a Continuation Application of U.S. application Ser. No. 13/040,418 filed Mar. 4, 2011 now U.S. Pat. No. 8,192,049, which claims priority from Korean Application No. 10-2010-0033014, filed Apr. 10, 2010, the subject matters of which are incorporated herein by reference.

BACKGROUND

1. Field

This embodiment relates to a lighting apparatus.

2. Description of the Related Art

A light emitting diode (hereinafter, referred to as LED) is an energy element that converts electric energy into light energy. The LED has advantages of high conversion efficiency, low power consumption and a long life span. As the advantages are widely spread, more and more attentions are now paid to a lighting apparatus using the LED. In consideration of the attention, manufacturer producing light apparatuses are now producing and providing various lighting apparatuses using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared to the direct lighting apparatus, the indirect lighting apparatus mitigates to some degree the intensified light emitted from the LED and protects the eyes of users.

SUMMARY

One embodiment is a lighting apparatus. The lighting apparatus includes: a body including a recess which is defined by an inner wall; a reflector which is disposed within the recess of the body and faces the inner wall of the body, and includes a reflective surface reflecting light to the outside of the recess of the body; and a light source which is disposed within the recess of the body and emits light toward the reflective surface of the reflector. The light source includes a substrate disposed on the inner wall of the body and a light emitting device disposed on the substrate. The body includes an opening through which the light reflected by the reflective surface of the reflector passes and includes a connecting member which is coupled to the body.

Another embodiment is a lighting apparatus. The lighting apparatus includes: a heat radiating body including a recess having a first shape, and an external appearance having a second shape; a reflector which is disposed in the recess of the heat radiating body and includes both a reflective surface reflecting light to the outside of the recess of the heat radiating body and a third shape; and a light source which is disposed in the recess of the heat radiating body and emits light to the reflective surface of the reflector. The second shape is different from the first shape. The third shape is different form the first shape.

Further another embodiment is a lighting apparatus. The lighting apparatus includes: The lighting apparatus includes: a heat radiating body which includes a first body having a first recess, and a second body having a second recess; a first substrate which is disposed in the first recess of the heat radiating body and includes a first light emitting device disposed therein; a second substrate which is disposed in the second recess of the heat radiating body and includes a second light emitting device disposed therein; and a reflector which is disposed within the first and the second recesses of the heat radiating body, and includes a first reflective surface reflecting light emitted from the first light emitting device of the first substrate to the outside of the first recess, and a second reflective surface reflecting light emitted from the second light emitting device of the second substrate to the outside of the second recess, and is disposed within the first and the second recesses. The first and the second bodies of the heat radiating body are coupled to each other to have a first shape. The first and the second recesses of the heat radiating body are coupled to each other to have a second shape different from the first shape.

DETAILED DESCRIPTION OF EMBODIMENTS

Hereinafter, embodiments will be described in detail with reference to the accompanying drawings.

Figure 1:
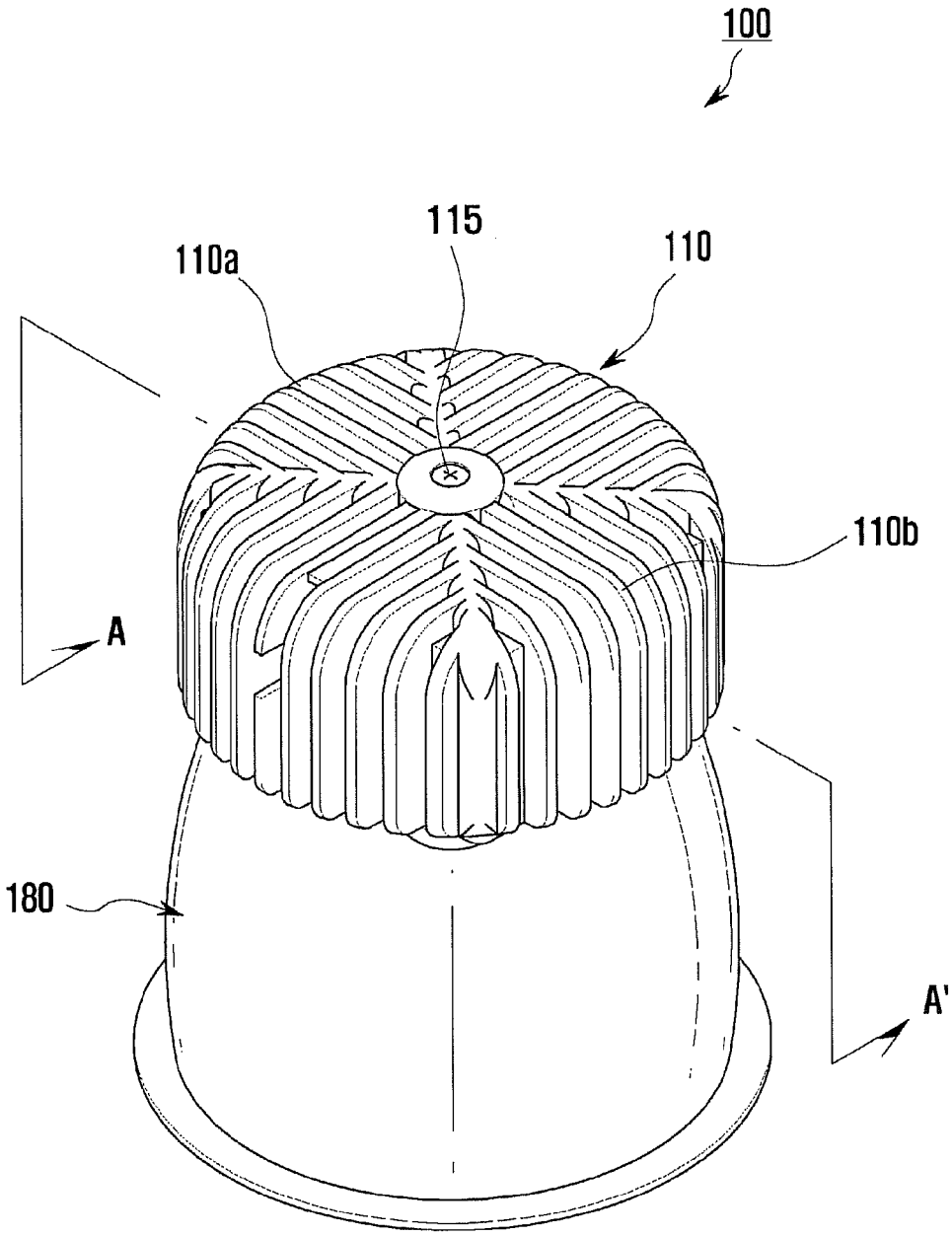
FIG. 1 is a perspective view showing a lighting apparatus according to an embodiment of the present invention.
Figure 2:
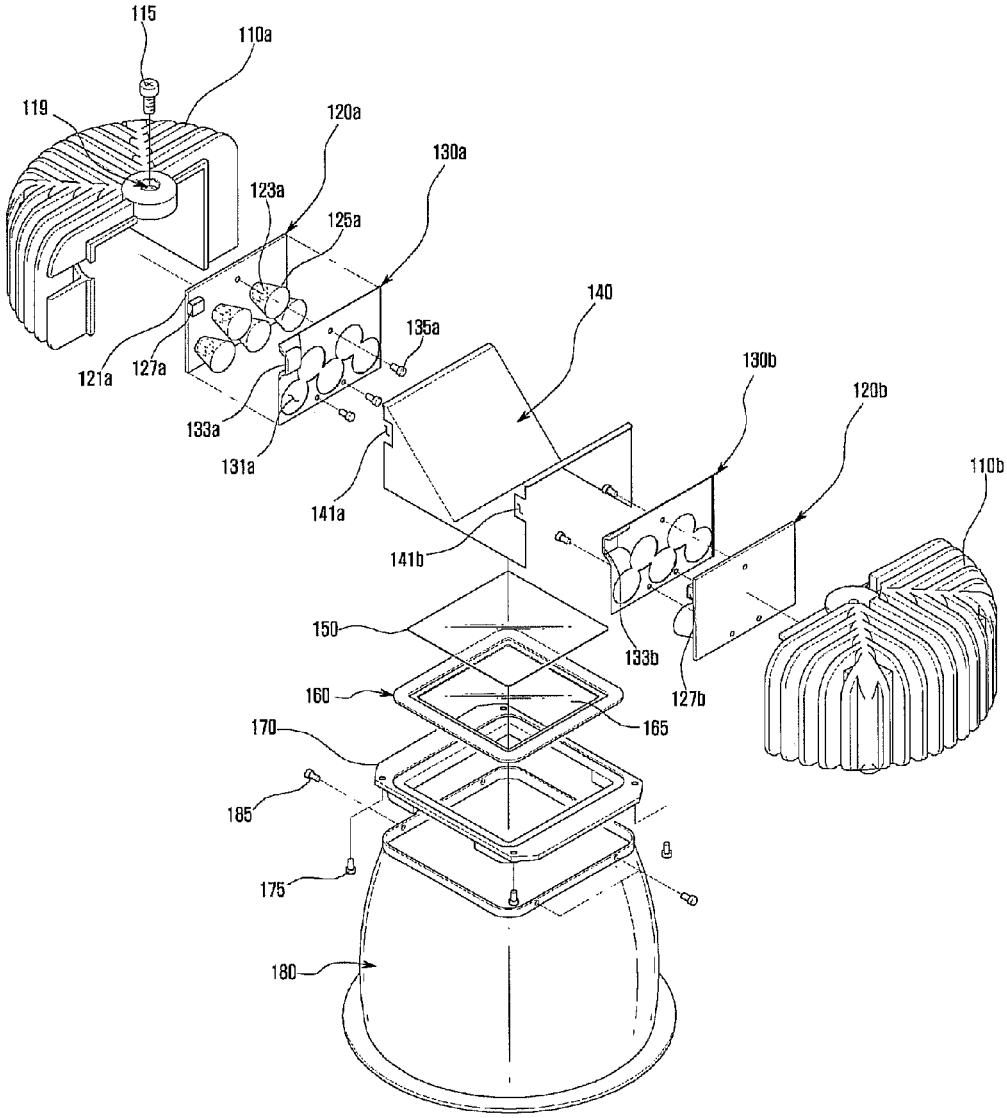
FIG. 2 is an exploded perspective view of a lighting apparatus shown in FIG. 1.
Figure 3:
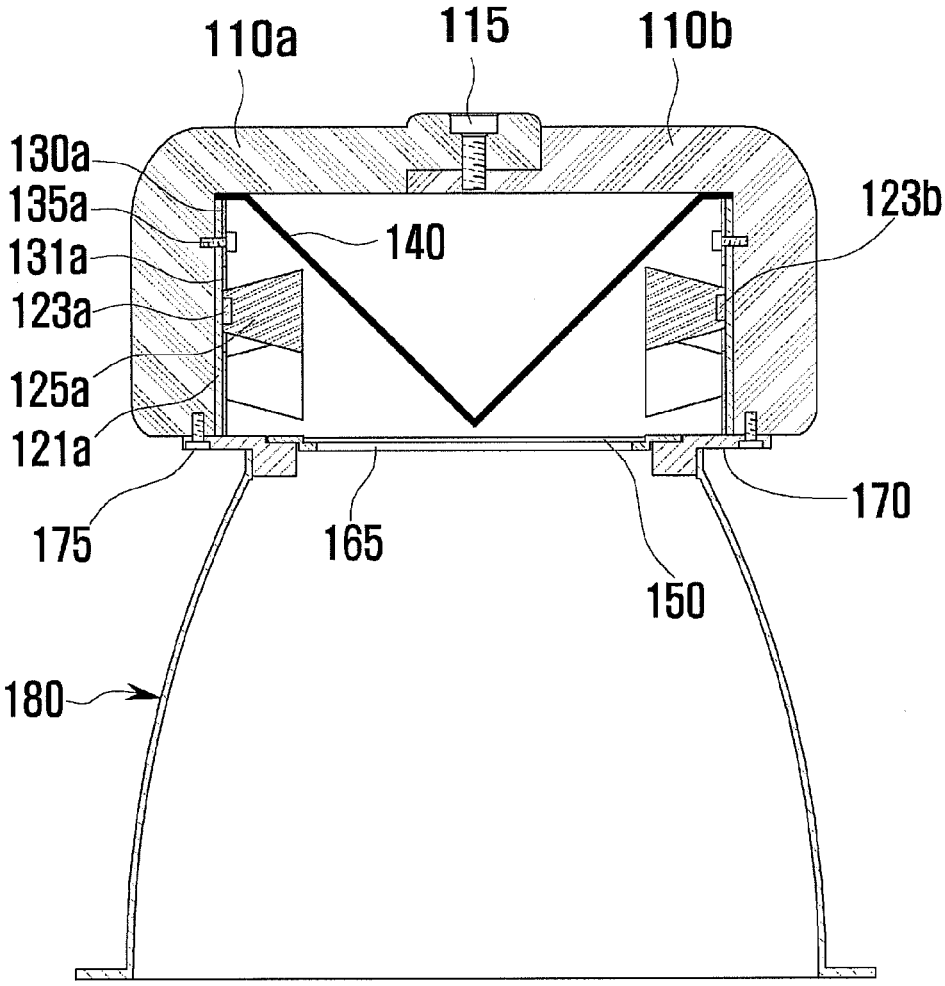
FIG. 3 is a cross sectional view of a lighting apparatus shown in FIG. 1.
Figure 4:
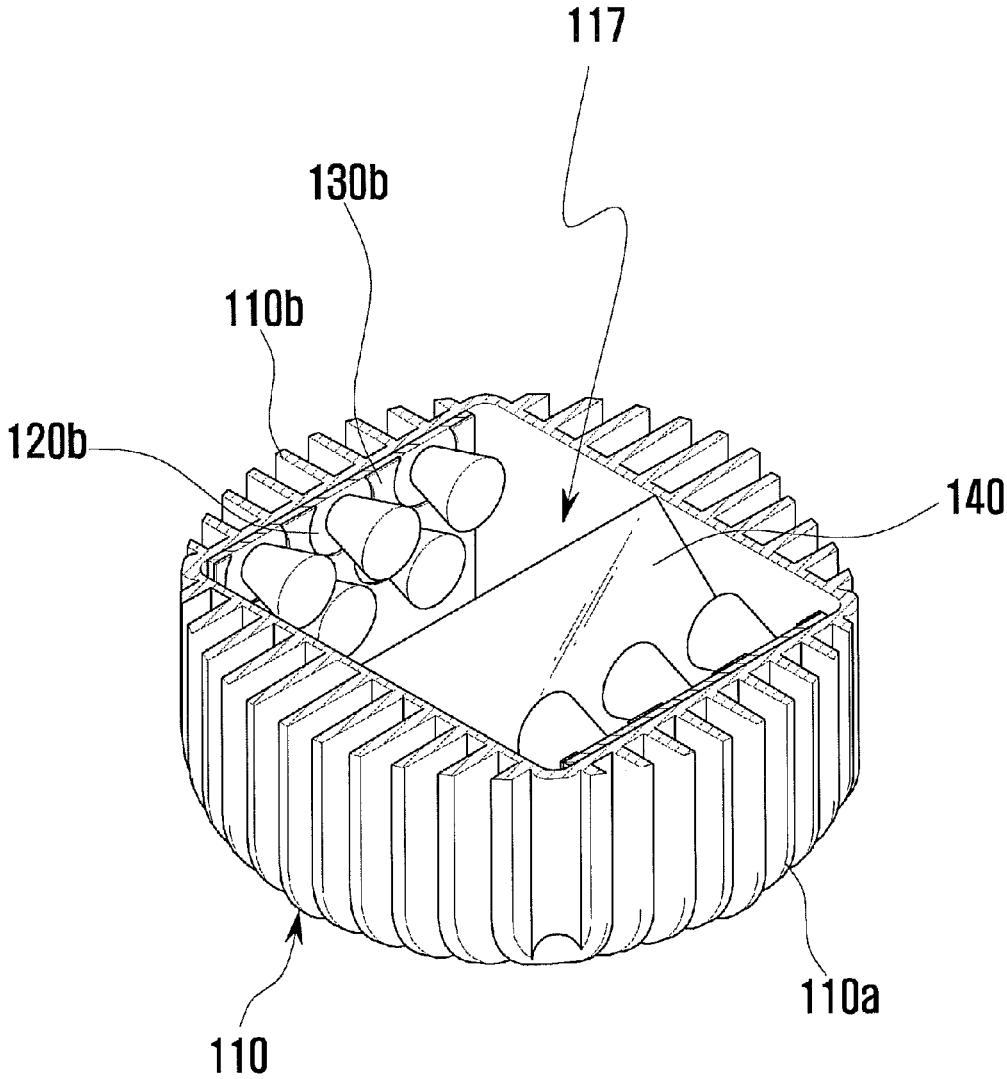
FIG. 4 is a bottom perspective view of a lighting apparatus shown in FIG. 1.

It will be understood that when an element is referred to as being "on" or "under" another element, it can be directly on/under the element, and one or more intervening elements may also be present FIG. 1 is a perspective view showing a lighting apparatus according to an embodiment of the present invention. FIG. 2 is an exploded perspective view of a lighting apparatus shown in FIG. 1. FIG. 3 is a cross sectional view taken along a line of A-A' in a lighting apparatus shown in FIG. 1. FIG. 4 is a bottom perspective view of a lighting apparatus shown in FIG. 1.

A lighting apparatus 100 according to an embodiment of the present invention will be described in detail with reference to FIGS. 1 to 4.

Referring to FIGS. 1 to 3, a heat radiating body 110 is formed by coupling a first heat radiating body 110*a* to a second heat radiating body 110*b*. A first screw 115 is coupled to a first female screw 119 such that the first heat radiating body 110*a* is easily coupled to the second heat radiating body 110*b*. When the first heat radiating body 110*a* and the second heat radiating body 110*b* are coupled to each other, a cylindrical heat radiating body 110 is formed.

Referring to FIGS. 1 to 3, the upper and lateral sides of the cylindrical heat radiating body 110 have a plurality of heat radiating fins for radiating heat generated from a first LED module 120*a* and a second LED module 120*b*. The plurality of the heat radiating fins widen a cross sectional area of the heat radiating body 110 and ameliorate the heat radiating characteristic of the heat radiating body 110. Regarding a plurality of the heat radiating fins, a cylindrical shape is formed by connecting the outermost peripheral surfaces of a plurality of the heat radiating fins.

Here, the cylindrical heat radiating body 110 does not necessarily have a plurality of the heat radiating fins. If the cylindrical heat radiating body 110 has no heat radiating fin, the cylindrical heat radiating body 110 may have a little lower heat radiating effect than that of the heat radiating body 110 shown in FIGS. 1 to 3. However, it should be noted that it is possible to implement the present invention without the heat radiating fins.

Referring to FIG. 4, the first LED module 120*a*, the second LED module 120*b*, a first fixing plate 130*a*, a second fixing plate 130*b* and a reflector 140 are housed inside the heat radiating body 110. A space for housing the first LED module 120*a*, the second LED module 120*b*, the first fixing plate 130*a*, the second fixing plate 130*b* and the reflector 140 has a hexahedral shape partitioned and formed by the inner walls of the heat radiating body 110. An opening 117 of the heat radiating body 110 is formed by opening one side of the hexahedron partitioned by the inner walls of the heat radiating body 110 and has a quadrangular shape. That is to say, the heat radiating body 110 has a cylindrical shape and the housing space inside the heat radiating body 110 has a hexahedral shape.

The first and the second heat radiating bodies 110*a* and 110*b* have integrally formed respectively. The first and the second heat radiating bodies 110*a* and 110*b* are manufactured with a material capable of well transferring heat. For example, Al and Cu and the like can be used as a material for the heat radiating bodies.

The first LED module 120*a*, i.e., a heat generator, is placed on the inner wall of the first heat radiating body 110*a*. The second LED module 120*b*, i.e., a heat generator, is placed on the inner wall of the second heat radiating body 110*b*. The first heat radiating body 110*a* is integrally formed, thus helping the heat generated from the first LED module 120*a* to be efficiently transferred. That is, once the heat generated from the first LED module 120*a* is transferred to the first heat radiating body 110*a*, the heat is transferred to the entire first heat radiating body 110*a*. Here, since the first heat radiating body 110*a* is integrally formed, there is no part preventing or intercepting the heat transfer, so that a high heat radiating effect can be obtained.

Similarly to the first heat radiating body 110*a*, the second heat radiating body 110*b* emits efficiently the heat generated from the second LED module 120*b*, i.e., a heat generator. The first and the second heat radiating bodies 110*a* and 110*b* are provided to the first and the second LED modules 120*a* and 120*b*, i.e., heat generators, respectively. This means that the heat radiating means one-to-one correspond to the heat generators and radiate the heat from the heat generators, thereby increasing the heat radiating effect. That is, when the number of the heat generators is determined and the heat generators are disposed, it is a part of the desire of the inventor of the present invention to provide the heat radiating means according to the number and disposition of the heat generators. As a result, a high heat radiating effect can be obtained. A description thereof will be given below with reference to FIGS. 5 and 6.

Figure 5:
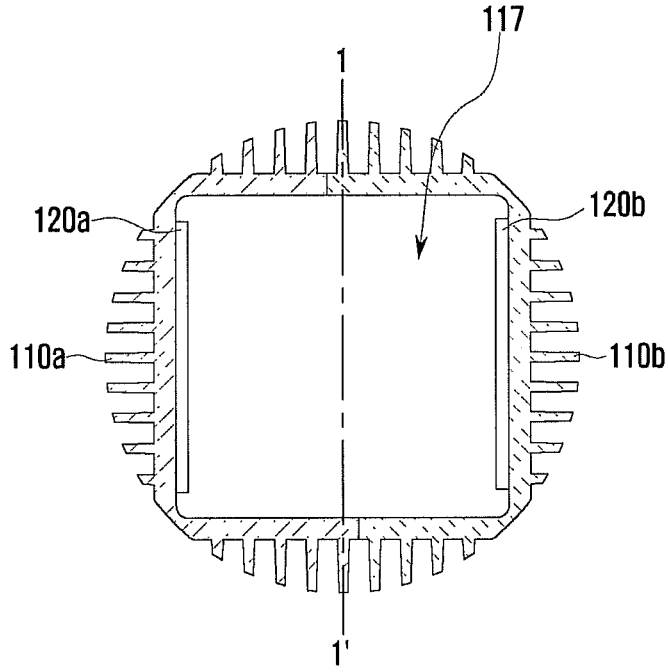
FIG. 5 is a view for describing a relation between a heat radiating body and an LED module in a lighting apparatus shown in FIG. 1.

FIG. 5 is a view for describing a relation between a heat radiating body and LED modules 120*a* and 120*b* in a lighting apparatus shown in FIG. 2 in accordance with an embodiment of the present invention. Here, FIG. 5 is a top view of the lighting apparatus shown in FIG. 4 and shows only the heat radiating body 110 and the LED modules 120*a* and 120*b*.

Referring to FIG. 5, the heat radiating body 110 and the opening 117 of the heat radiating body 110 have a circular shape and a quadrangular shape, respectively. The heat radiating body 110 includes five inner surfaces. The five inner surfaces and the opening 117 partition and form a space for housing the first and the second LED modules 120*a* and 120*b*, the first and the second fixing plates 130*a* and 130*b* and the reflector 140.

The first and the second heat radiating bodies 110*a* and 110*b* constituting the heat radiating body 110 have a semi-cylindrical shape respectively. The two heat radiating bodies are coupled to each other based on a first base line 1-1*e* and then form a cylindrical heat radiating body 110. However, the coupling boundary line is not necessarily the same as the first base line 1-1'. For example, the base line 1-1' is rotatable clockwise or counterclockwise to some degree around the center of the heat radiating body 110.

Since the heat radiating body 110 has a cylindrical shape, the heat radiating body 110 can be easily installed by being inserted into a ceiling's circular hole in which an existing lighting apparatus has been placed. Moreover, the heat radiating body 110 is able to easily take the place of the existing lighting apparatus which has been already used.

As shown in FIG. 5, the LED modules are placed on two inner walls which face each other in four inner surfaces of the heat radiating body 110 excluding the inner wall facing the opening 117.

The first LED module 120*a* is placed on the inner wall of the first heat radiating body 110*a*. The first heat radiating body 100*a* further includes three inner walls other than the inner wall on which the first LED module 120*a* has been placed. Therefore, the heat generated from the first LED module 120*a*, i.e., a heat generator, can be radiated through the three inner walls as well as the inner wall on which the first LED module 120*a* has been placed.

The second LED module 120*b* is placed on the inner wall of the second heat radiating body 110*b*. The second heat radiating body 100*b* further includes three inner walls other than the inner wall on which the second LED module 120*b* has been placed. Therefore, the heat generated from the second LED module 120*b*, i.e., a heat generator, can be radiated through the three inner walls as well as the inner wall on which the second LED module 120*b* has been placed.

While the first heat radiating body 110*a* is coupled to the second heat radiating body 110*b*, the first and the second LED modules 120*a* and 120*b*, i.e., heat generators, emit light toward the center of the cylindrical heat radiating body, and then the heat generated from the LED modules is radiated through the first and the second heat radiating bodies 110*a* and 110*b* which are respectively located on the circumference in an opposite direction to the center of the heat radiating body 110. From the viewpoint of the entire heat radiating body 110, the heat is hereby radiated in a direction from the center to the circumference and in every direction of the circumference, obtaining a high heat radiating effect. Moreover, since a heat radiating member such as the heat radiating fin formed on the heat radiating body is widely provided on the circumference of the cylindrical heat radiating body, the heat radiating member has high design flexibility.

Figure 6:
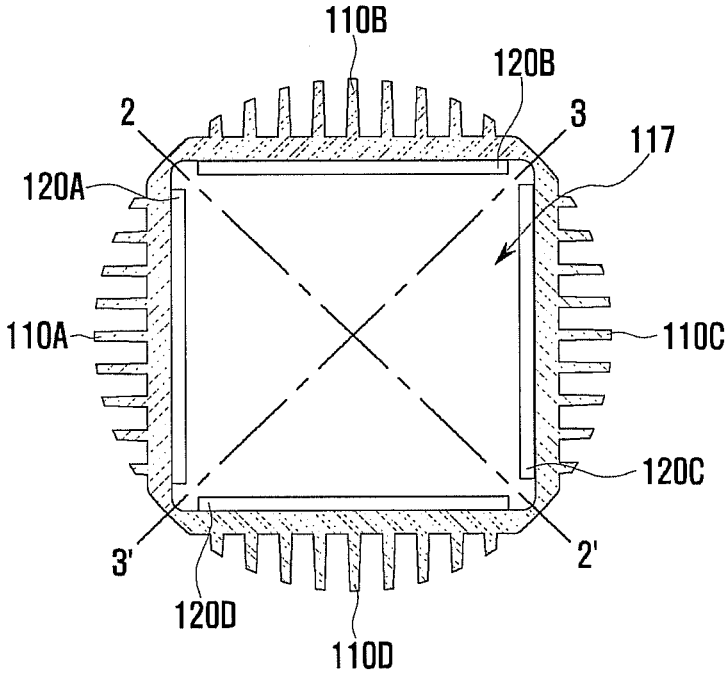
FIG. 6 shows another embodiment of a lighting apparatus shown in FIG. 1.

FIG. 6 is a view for describing a relation between a heat radiating body and an LED module in accordance with another embodiment of the present invention.

Referring to FIG. 6, similarly to the case of FIG. 5, the heat radiating body 110 and the opening 117 of the heat radiating body 110 have a circular shape and a quadrangular shape, respectively.

The heat radiating body 110 is divided into four heat radiating bodies 110*a*, 110*b*, 110*c* and 110*d* on the basis of a second base axis 2-2' and a third base axis 3-3'. In other words, one cylindrical heat radiating body 110 is formed by coupling the four heat radiating bodies 110*a*, 110*b*, 110*c* and 110*d*.

With respect to five inner walls of the heat radiating body 110, the four LED modules 120*a*, 120*b*, 120*c* and 120*d* are respectively placed on four inner walls excluding the inner wall facing the opening 117.

As such, the lighting apparatuses shown in FIGS. 5 and 6 include a plurality of the heat radiating bodies of which the number is the same as the number of the LED module of a heat generator. The first and the second heat radiating bodies 110*a* and 110*b* are respectively integrally formed with the first and the second LED modules 120*a* and 120*b* of heat generators. Here, the first and the second heat radiating bodies 110*a* and 110*b* can be integrally formed by a casting process. Since the first and the second heat radiating bodies 110*a* and 110*b* formed integrally in such a manner do not have a join or a part where the two heat radiating bodies are coupled, the transfer of the heat generated from the heat generators is not prevented or intercepted.

Since not only the inner wall on which the LED module is placed but an inner wall on which the LED module is not placed are included in one cylindrical heat radiating body 110 formed by coupling the first and the second heat radiating bodies 110*a* and 110*b*, the heat radiating body 110 has a more excellent heat radiating effect than that of a conventional lighting apparatus having a heat radiating body formed only on the back side of the inner wall on which the LED module is placed.

Additionally, as described above in connection with FIG. 5, the LED modules emit light toward the center of the cylindrical heat radiating body and the heat generated from the LED modules is radiated through the heat radiating bodies which are respectively located on the circumference in an opposite direction to the center of the cylindrical heat radiating body. The heat is hereby radiated in a direction from the center to the circumference and in every direction of the circumference, obtaining a high heat radiating effect. Moreover, since a heat radiating member such as the heat radiating fin formed on the heat radiating body is widely provided on the circumference of the cylindrical heat radiating body, the heat radiating member has high design flexibility.

Hereinafter, components housed in the inner housing space of the cylindrical heat radiating body 110 will be described in detail with reference to FIGS. 2 to 4. Here, the first LED module 120*a* and the second LED module 120*b* face each other with respect to the reflector 140 and have the same shape. The first fixing plate 130*a* and the second fixing plate 130*b* face each other with respect to the reflector 140 and have the same shape. Therefore, hereinafter a detailed description of the second LED module 120*b* and the second fixing plate 130*b* are omitted.

The first LED module 120*a* includes a substrate 121*a*, a plurality of LEDs 123*a*, a plurality of collimating lenses 125*a*, a projection 127*a* and a holder 129*a*.

A plurality of the LEDs 123*a* and a plurality of the collimating lenses 125*a* are placed on one surface of the substrate 121*a*. The other surface of the substrate 121*a* is fixed close to the inner wall of the heat radiating body 110*a*.

A plurality of the LEDs 123*a* are disposed separately from each other on the one surface of the substrate 121*a* in a characteristic pattern. That is, a plurality of the LEDs 123*a* are disposed in two lines. Also, the plurality of the LEDs 123*a* can be disposed in three or more lines based on a size of the substrate or a number of the LEDs. In FIG. 2, two LEDs are disposed in the upper line in the substrate 121*a* and three LEDs are disposed in the lower line. The characteristic of disposition of a plurality of the LEDs 123*a* will be described later with reference to FIGS. 8 to 9.

The collimating lens 125*a* collimates in a predetermined direction the light emitted from around the LED 123*a*. Such a collimating lens 125*a* is formed on the one surface of the substrate 121*a* and surrounds the LED 123*a*. The collimating lens 125*a* has a compact funnel shape. Therefore, the collimating lens 125*a* has a lozenge-shaped cross section.

Meanwhile, a groove for receiving the LED 123*a* is formed on one surface on which the collimating lens 125*a* comes in contact with the substrate 121*a*.

The collimating lenses 125*a* correspond to the LEDs 123*a*. Thus, the number of the collimating lenses 125*a* is equal to the number of the LEDs 123*a*. Here, it is desirable that the collimating lens 125*a* has a height greater than that of the LED 123*a*.

Such a collimating lens 125*a* collimates the light, which is emitted from around the LED 123*a*, into the reflector 140. The collimating lens 125*a* surrounds the LED 123*a* such that a user is not able to directly see the intensified light emitted from the LED 123*a*. To this end, the outside of the collimating lens 125*a* can be made of an opaque material.

The inside of the collimating lens 125*a* shown in FIG. 2 can be filled with an optical-transmitting material having a predetermined refractive index, for example, an acryl and PMMA, etc. Also, a fluorescent material can be further included in the inside of the collimating lens 125*a*.

A projection 127*a* is received by a receiver 133*a* of the first fixing plate 130*a*. Subsequently, the back side to the side in which the receiver 133*a* is formed has a projecting shape and is received by a locking part 141*a* of the reflector 140. An embodiment without either the first fixing plate 130*a* or the receiver 133*a* of the first fixing plate 130*a* can be provided. In this case, the projection 127*a* can be directly received by the locking part 141*a* of the reflector 140. Such a projection 127*a* functions as a male screw of a snap fastener. The receiver 133*a* and the locking part 141*a* function as a female screw of a snap fastener.

After the projection 127*a* is in contact with and coupled to the locking part 141*a* directly or through the receiver 133*a* of the first fixing plate 130*a*, the reflector 140 is fixed to the first fixing plate 130*a* or the first LED module 120*a*. Therefore, the reflector 140 is prevented from moving toward the opening 117 (i.e., a light emission direction). In addition, the inner walls of the heat radiating body 110 prevents the reflector 140 from moving in a light emitting direction of the reflector 140. The reflector 140 is also prevented from moving in a light emission direction of the LED modules 120*a* and 120*b* by either the LED modules 120*a* and 120*b* fixed to the heat radiating body 110 or the fixing plates 130*a* and 130*b* fixed to the heat radiating body 110.

Accordingly, it is not necessary to couple the reflector 140 to the first LED module 120a or to the inner wall of the first heat radiating body 110*a* by use of a separate fixing means such as a screw and the like. Moreover, there is no requirement for a separate fixing means for fixing the reflector 140 to the inner walls of the first and the second heat radiating bodies 110*a* and 110*b*. As mentioned above, since the reflector 140 has no additional part like a through-hole for allowing a separate fixing means to pass, the reflector 140 can be formed to have its minimum size for obtaining a slope-shaped reflecting area. This means that it is possible to cause the lighting apparatus according to the embodiment of the present invention to be smaller in comparison with the amount of the emitted light.

Figure 7A:
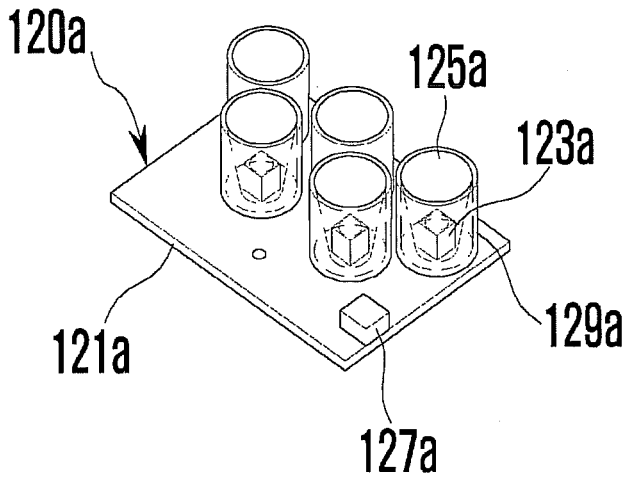
FIGS. 7*a* and 7*b* are perspective view and exploded view of another embodiment of the LED module shown in FIG. 2.
Figure 7B:
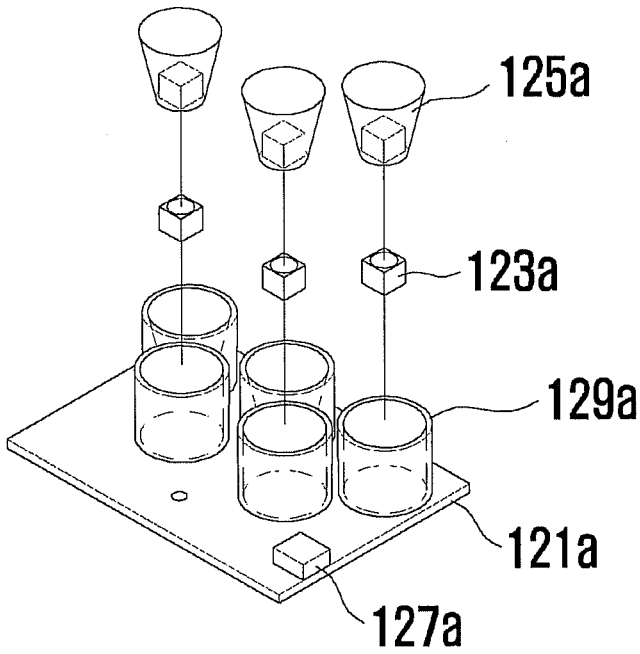

FIGS. 7*a* and 7*b* are perspective view and exploded view of another embodiment of the LED module shown in FIG. 2 in accordance with the embodiment of the present invention.

The LED module 120*a* shown in FIGS. 7*a* and 7*b* in accordance with another embodiment is obtained by adding a holder 129*a* to the LED module 120*a* shown in FIG. 2.

The holder 129*a* has an empty cylindrical shape. The top and bottom surfaces of the holder 129*a* are opened. The holder 129*a* surrounds the collimating lens 125*a* on the substrate 121*a*. The holder 129*a* performs a function of fixing the collimating lens 125*a*.

Referring to FIGS. 2 and 3 again, the first fixing plate 130*a* includes a plurality of through holes 131*a*, the receiver 133*a* and a plurality of second male screws 135*a*. It is desirable that the first fixing plate 130*a* has a shape that is the same as or similar to that of the substrate 121*a*.

One collimating lens 125*a* is inserted into one through hole 131*a*. It is desired that the through hole 131*a* has a shape allowing the collimating lens 125*a* to pass the through hole 131*a*

The receiver 133 is able to receive the projection 127*a* of the first LED module 120*a*. When the receiver 133 receives the projection 127*a*, the first LED module 120*a* and the first fixing plate 130*a* are fixed close to each other. When the projection 127*a* is attached to or removed from the receiver 133, the first fixing plate 130*a* is easily attached to or removed from the first LED module 120*a*.

A plurality of the second male screws 135*a* penetrate the first fixing plate 130*a* and the first LED module 120*a*, and then is inserted and fixed into a plurality of second female screws (not shown) formed on the inner wall of the first heat radiating body 110*a*. The first fixing plate 130*a* and the first LED module 120*a* are easily attached and fixed to the inner wall of the first heat radiating body 110*a* by a plurality of the second male screws 135*a* and are also easily removed from the inner wall of the first heat radiating body 110*a*.

The reflector 140 changes the path of light emitted from the first and the second LED modules 120*a* and 120*b*. Referring to FIG. 4, the reflector 140 reflects to the opening 117 the light emitted from the first and the second LEDs 123*a* and 123*b*. As shown in FIG. 2, the reflector 140 has an overall shape of an empty hexahedron. Here, one pair of lateral sides among two pairs of lateral sides facing each other is opened. The upper side functioning to reflect the light has a 'V' shape. The bottom side corresponds to the opening 117.

The first and the second fixing plates 130*a* and 130*b* and the first and the second LED modules 120*a* and 120*b* are coupled to the opened lateral sides. The two opened lateral surfaces of the reflector 140 are hereby closed. Here, projecting parts are formed on the back sides of the sides on which the receivers 133*a* and 133*b* receiving the projections 127*a* and 127*b* are formed. Locking parts 141*a* and 141*b* are formed in the reflector 140 such that the projecting parts are in a contact with and are coupled to the locking parts 141*a* and 141*b*. Therefore, the first and the second fixing plates 130*a* and 130*b* can be securely fixed to the reflector 140. Here, as described above, the projection 127*a* can be directly received by the locking part 141*a* without the first fixing plate 130*a* or the receiver 133*a* of the first fixing plate 130*a*.

The reflector 140 has a shape corresponding to the housing space of the heat radiating body 110. That is, the reflector 140 is formed to be exactly fitted to the housing space partitioned and formed by the inner walls of the heat radiating body 110. Thus, when the first and the second heat radiating bodies 110*a* and 110*b* are coupled to each other, the reflector 140 is fitted exactly to the housing space and is not able to move inside the heat radiating body 110.

As described above, the reflector 140 is prevented from moving toward the opening 117 (i.e., the light emission direction) by the projections 127*a* and 127*b* of the first and the second LED modules 120*a* and 120*b*. In addition, the reflector 140 has a shape fitting well into the housing space of the heat radiating body 110. As a result, when the first and the second heat radiating bodies 110*a* and 110*b* are coupled to each other, the first and the second heat radiating bodies 110*a* and 110*b* give a pressure to the reflector 140. Therefore, the reflector 140 is prevented from moving not only in the light emission direction but in a direction perpendicular to the light emission direction.

Accordingly, the lighting apparatus according to the present invention does not require a separate fixing means such as a screw for fixing the reflector 140 to the inside of the heat radiating body 110. Additionally, the reflector 140 can be formed to have its minimum size for obtaining a slope-shaped reflecting area. This means that it is possible to cause the lighting apparatus to be smaller in comparison with the amount of the emitted light.

The projections of the first and the second LED modules 120*a* and 120*b* are fitted and coupled to the receivers of the first and the second fixing plates 130*a* and 130*b* respectively, and are fixed to the inner walls of the heat radiating bodies 110*a* and 110*b*, respectively. Then, the receivers 133*a* and 133*b* are disposed to be in contact with and coupled to the locking parts 141*a* and 141*b* by disposing the reflector 140 between the receivers 133*a* and 133*b*. The first and the second heat radiating bodies 110*a* and 110*b* are coupled to each other toward the reflector 140 so that the reflector 140 is fixed to the inside housing space of the heat radiating body 110. As a result, since there is no requirement for a separate screw for fixing the reflector 140 to the heat radiating body 110 having the opening formed therein in one direction, it is easy to assemble the lighting apparatus of the present invention.

Referring to FIGS. 2 and 3 again, the "V"-shaped upper side (hereinafter, referred to as a reflective surface) reflects the light emitted from the first and the second LED modules 120*a* and 120*b* and changes the path of the light to the opening 117.

That is, the reflective surface of the reflector 140 is inclined toward the opening 117 of the heat radiating body with respect to one sides of the first and the second LED modules, for example, one side of the substrate.

The reflective surface includes two surfaces inclined with respect to the one sides of the first and the second LED modules, and the two surfaces are in contact with each other at a predetermined angle. Herein, the predetermined angle may be in a range of 30 degree~150 degree with respect to the one sides of the first and the second LED modules. The predetermined angle may be desirably in 60 degree~120 degree with respect to the one sides of the first and the second LED modules.

Light incident from the first and the second LED modules 120*a* and 120*b* formed at both sides of the reflective surface to the reflective surface of the reflector 140 is reflected by the reflective surface and moves toward the opening (i.e., the light emission direction), that is, in the down direction of FIG. 1. In this case, images formed on the reflective surface of the reflector 140 are distributed based on the properties of the distribution of the LEDs of the first and the second LED modules 120*a* and 120*b*. For a detailed description of this matter, the characteristic of the distribution of the LEDs of the first and the second LED modules 120*a* and 120*b* will be described with reference to FIGS. 8 and 9.

Figure 8:
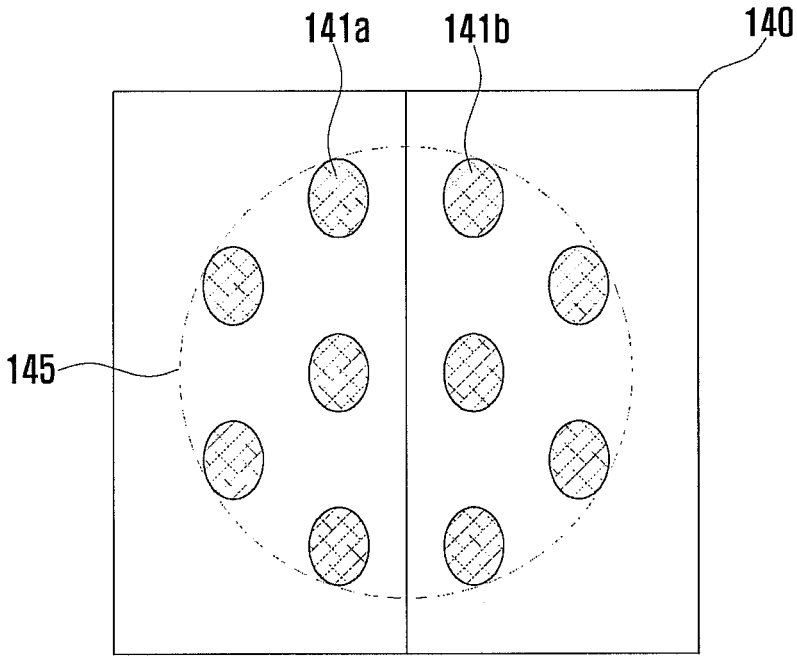
FIG. 8 is a top view of the lighting apparatus shown in FIG. 4.
Figure 9:
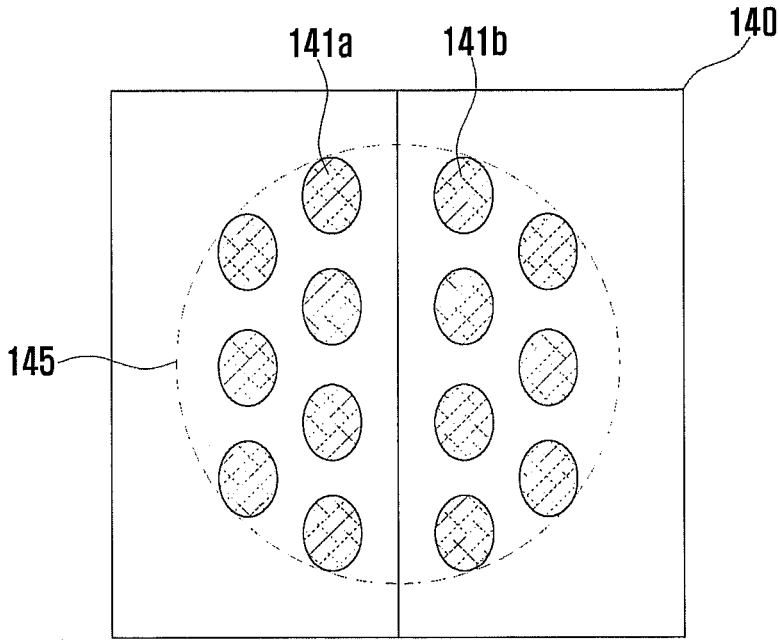
FIG. 9 shows another embodiment of the lighting apparatus shown in FIG. 4.

FIG. 8 is a top view of the lighting apparatus shown in FIG. 4 in accordance with the embodiment of the present invention. When light emitted from a plurality of the LEDs 123*a* and 123*b* of the first and the second LED modules 120*a* and 120*b* is incident on the reflective surface of the reflector 140, the distribution of the images 141*a* and 141*b* formed on the reflective surface is shown in FIG. 8. Here, assuming that the reflective surface of the reflector 140 shown in FIGS. 8 and 9 is a mirror surface, FIGS. 8 and 9 show images observed through the opening 117. Actually, the reflective surface is not necessarily a mirror surface and requires a material capable of reflecting the incident light in the light emission direction.

Referring to FIG. 8, when light emitted from each of a plurality of the LEDs 123*a* and 123*b* of the first and the second LED modules 120*a* and 120*b* is incident on the reflective surface of the reflector 140, eight images located at the outermost circumference among the images 141*a* and 141*b* formed on the reflective surface form a concentric circumference 145. The other two images are uniformly distributed within the concentric circumference 145. The eight images located at the outermost circumference may be disposed on the circumference 145 at a regular interval.

FIG. 9 shows a lighting apparatus having increased number of the LEDs in accordance with the embodiment of the present invention.

In FIG. 9, with regard to the LEDs disposed in the first LED module 120*a* shown in FIGS. 1 to 4, four LEDs are arranged in the first line and three LEDs are arranged in the second line, and the same is true for the second LED module 120*b*. Therefore, the first and the second LED modules 120*a* and 120*b* totally have fourteen LEDs.

Like the lighting apparatus shown in FIG. 8, the lighting apparatus shown in FIG. 9 has fourteen images 141*a* and 141*b* which are uniformly distributed at a regular interval. That is, all adjacent images of images which are aligned in one line have a same interval between them and all adjacent images of images which are aligned in adjacent lines also have a same interval between them. Eight images located at the outermost circumference of the fourteen images 141*a* and 141*b* form the concentric circumference 145.

As shown in FIGS. 8 and 9, when the lights emitted from a plurality of the LEDs 123*a* and 123*b* form images on the reflective surface of a mirror surface of the reflector 140, the images are symmetrical to each other with respect to the central axis of the reflector. Here, the light emitted from the plurality of the LEDs is reflected and irradiated by the reflective surface of the reflector, and then is projected to a plane. In this case, the images of the outermost light sources are distributed on the plane to substantially have a circular shape. Therefore, even if the first and the second LED modules 120*a* and 120*b* are arranged to face each other, light emitted from the lighting apparatus according to the present invention is able to form a circle on an irradiated area. A detailed description of this matter will be described later with reference to FIGS. 13*c* to 16*c*.

An optic sheet 150 converges or diffuses light reflected from the reflective surface of the reflector 140. That is, the optic sheet 150 is able to converge or diffuse light in accordance with a designer's choice.

As shown in FIGS. 2 and 3, an optic plate 160 receives the optic sheet 150 and stops the optic sheet 150 from being transformed by the heat. Besides, the optic plate 160 prevents a user from directly seeing the light emitted from the LED 123*a* through a reflection cover 180. Such an optic plate 160 will be described in detail with reference to FIGS. 3 and 10.

Figure 10:
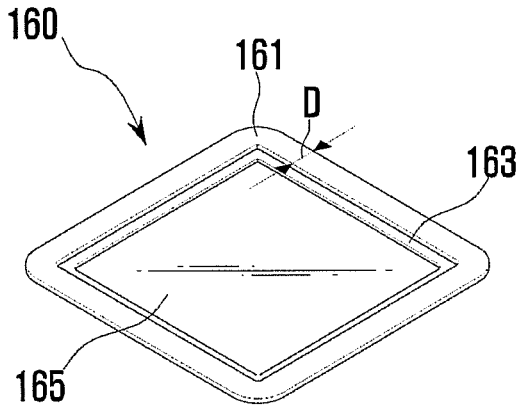
FIG. 10 is a perspective view of an optic plate shown in FIG. 2.

FIG. 10 is a perspective view of an optic plate 160.

Referring to FIGS. 3 and 10, the optic plate 160 includes a first frame 161, a second frame seating the optic sheet 150, and a glass plate 165 which is inserted and fixed to the second frame 163 and prevents the optic sheet 150 from being bent in the light emission direction by heat.

The first frame 161 has a structure surrounding all corners of the optic sheet 150 and has a predetermined area of "D" from the outer end to the inner end thereof.

The second frame 163 is extended by a predetermined length from the lower part of the inner end of the first frame 161 toward the center of the optic plate 160 such that the optic sheet 150 is seated.

The first and the second frames 161 and 163 receive and fix the optic sheet 150. Additionally, a connecting member 170 and the first and the second frames 161 and 163 prevent a user from directly seeing the light emitted from the LED 123*a* through the reflection cover 180.

The glass plate 165 is inserted and fixed to the second frame 163 and prevents the optic sheet 150 from being bent in the light emission direction by heat.

Meanwhile, while the optic sheet 150 and the optic plate 160 are described as separate components in FIGS. 2, 3 and 10, the function of the optic sheet 150 may be included in the glass plate 165 of the optic plate 160. In other words, the optic plate 160 per se is able to converge and diffuse light.

The connecting member 170 is coupled to the heat radiating body 110 and to the reflection cover 180 respectively. As a result, the heat radiating body 110 is coupled to the reflection cover 180. The connecting member 170 receives the optic plate 160 and fixes the received optic plate 160 so as to cause the optic plate 160 not to be fallen to the reflection cover 180. The connecting member 170 as well as the optic plate 160 prevents a user from directly seeing the light emitted from the LED 123*a* through the reflection cover 180. The connecting member 170 will be described in detail with reference to FIGS. 3 and 11.

Figure 11:
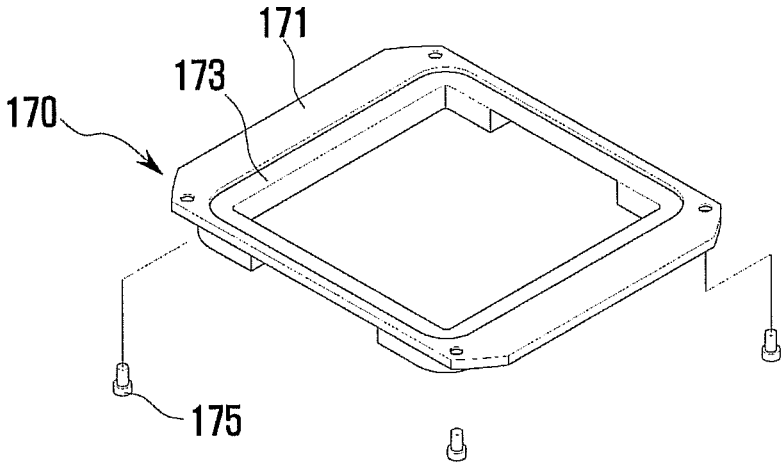
FIG. 11 is a perspective view of a connecting member shown in FIG. 2.

FIG. 11 is a perspective view of the connecting member 170.

Referring to FIGS. 3 and 11, the connecting member 170 includes a third frame 171 preventing the optic plate 160 received in the connecting member 170 from moving, and a fourth frame 173 seating the optic plate 160 and preventing the optic plate 160 from being fallen to the reflection cover 180.

The third frame 171 surrounds the first frame 161 of the optic plate 160. Each corner of the third frame 171 has a hole formed therein for inserting a first coupling screw 175. The heat radiating body 110 and the connecting member 170 can be securely coupled to each other by inserting the first coupling screw 175 into the hole formed in the corner of the third frame 171.

The fourth frame 173 is extended by a predetermined length from the lower part of the inner end of the third frame 171 toward the center of the connecting member 170 such that the first frame 161 of the optic plate 160 is seated. Also, the fourth frame 173 is extended by a predetermined length in a direction in which the connecting member 170 is coupled to the reflection cover 180.

The third and fourth frames 171 and 173 receive or fix the optic plate 160 and prevent a user from directly seeing the light emitted from the LED 123*a* through a reflection cover 180.

Figure 12:
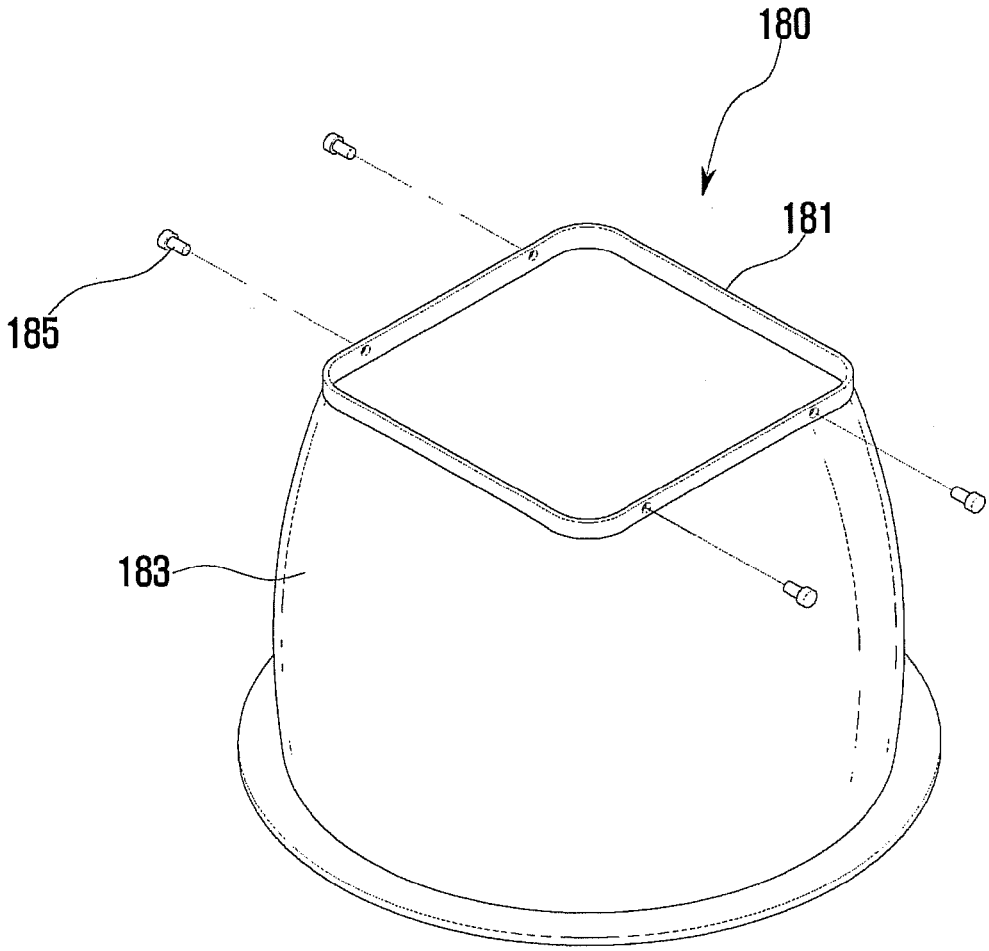
FIG. 12 is a perspective view of a reflection cover 180 shown in FIG. 2.

FIG. 12 is a perspective view of a reflection cover 180. Referring to FIG. 12, the first and the second LED modules emit light and the reflector 140 reflects the light. Then, the light transmits the optic sheet 150 and the glass plate 165. Here, the reflection cover 180 guides the light such that the light is prevented from being diffused in all directions. That is, the reflection cover 180 causes the light to travel toward the bottom thereof so that the light is converged within a predetermined orientation angle.

The reflection cover 180 includes a fifth frame 181 surrounding the fourth frame 173 of the connecting member 170 such that the reflection cover 180 contacts strongly closely with the connecting member 170, and includes a cover 183 converging in the down direction the light which has transmitted the optic sheet 150 and the glass plate 165.

The fifth frame 181 can be more securely coupled to the fourth frame 173 by means of a second coupling screw 185.

The cover 183 has an empty cylindrical shape. The top and bottom surfaces of the cover 183 are opened. The radius of the top surface thereof is less than that of the bottom surface thereof. The lateral surface thereof has a predetermined curvature.

Hereinafter, the effect of the lighting apparatus according to the embodiment of the present invention will be described with various experiments.

Figure 13A:
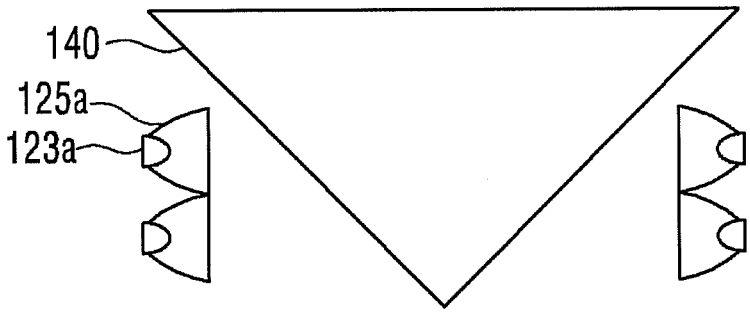
FIGS. 13*a* to 13*c* show data resulting from a first experiment.
Figure 13B:
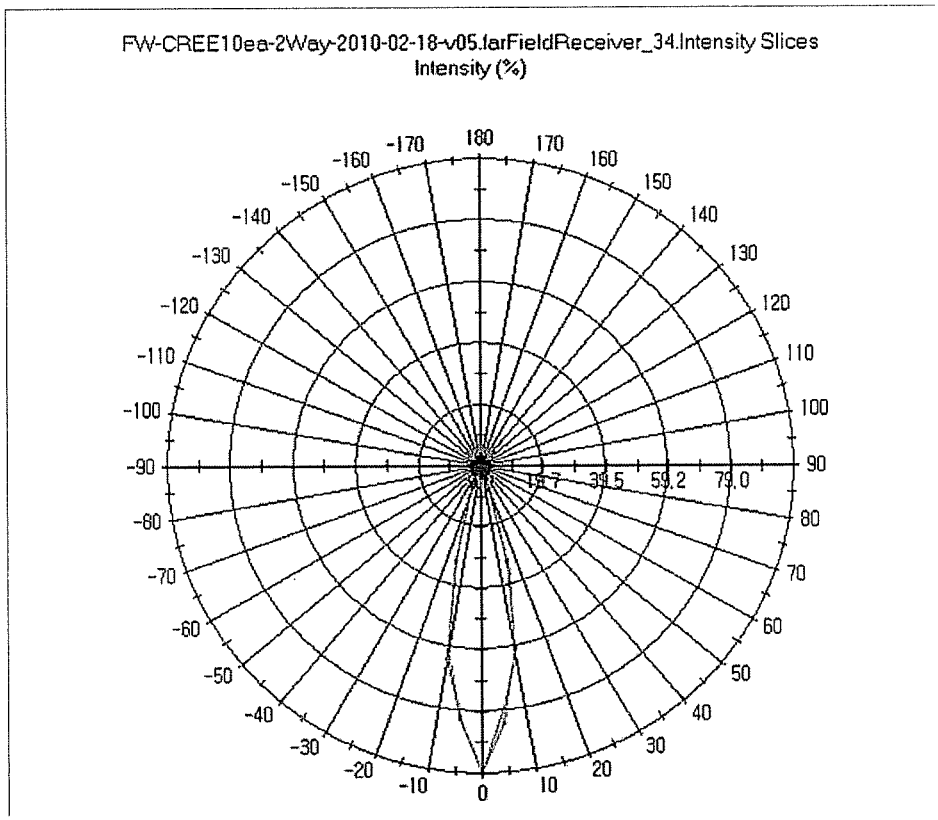
Figure 13C:
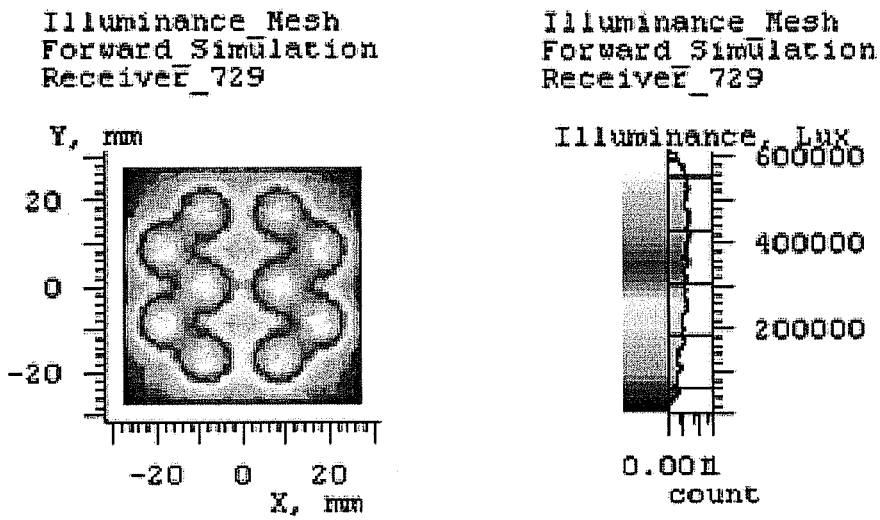

FIGS. 13*a* to 13*c* show data resulting from a first experiment.

The first experiment employs, as shown in FIG. 13*a*, the reflector 140 having a specula reflectance of 96% and the collimating lens 125*a* having an efficiency of 92%. Also, both the heat radiating body 110 having a diameter of 3 inches and the substrates 121*a* and 121*b* of the first and the second LED modules 120*a* and 120*b* are used in the first experiment. Here, the substrates 121*a* and 121*b* are covered with white paint.

FIG. 13*b* is a graph showing a luminous intensity of the first experiment. Referring to FIG. 13*b*, it is understood that the orientation angle of the light emitted from the lighting apparatus of the first experiment is about 23° and the light also converges in a vertical direction (i.e., 0°).

FIG. 13*c* is a graph showing an illuminance of the first experiment.

Referring to FIG. 13*c*, it is understood that ten dots are uniformly distributed on an irradiated area due to the properties of the distribution of ten LEDs and is understood that dots located at the outermost circumference form a circle. It can be found that the illuminance of the center of each dot reaches 600,000 LUX.

As a result of the first experiment shown in FIGS. 13*a* to 13*c*, the efficiency of the lighting apparatus of the first experiment is about 82%.

Figure 14A:
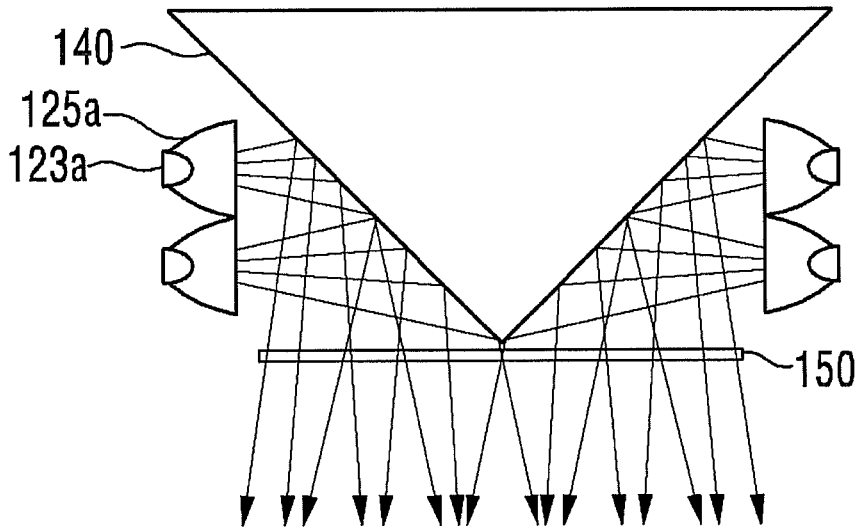
FIGS. 14*a* to 14*c* show data resulting from a second experiment.
Figure 14B:
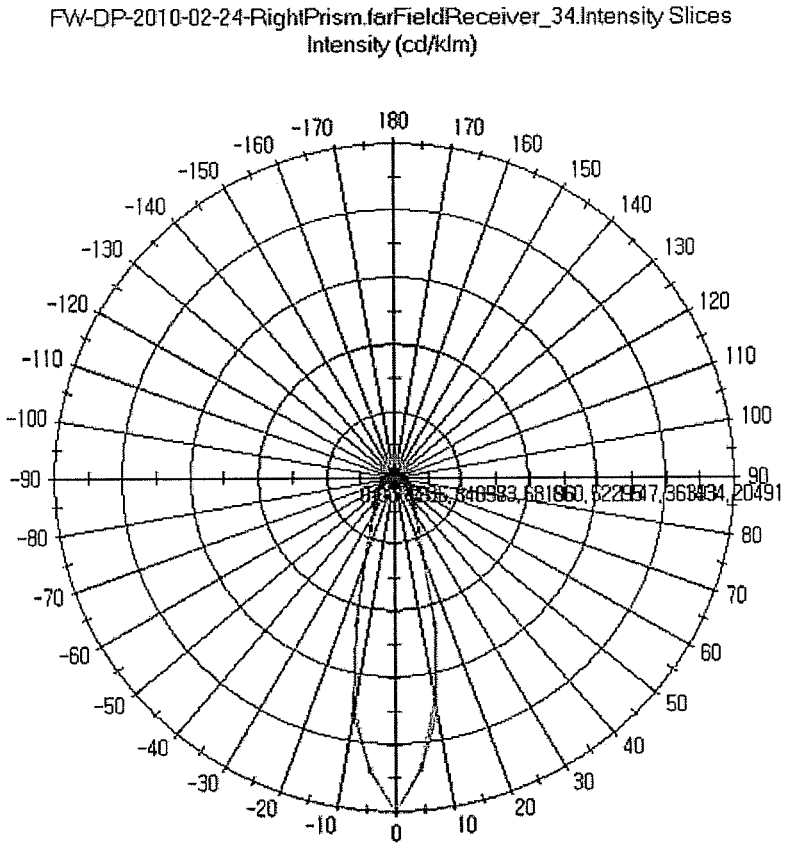
Figure 14C:
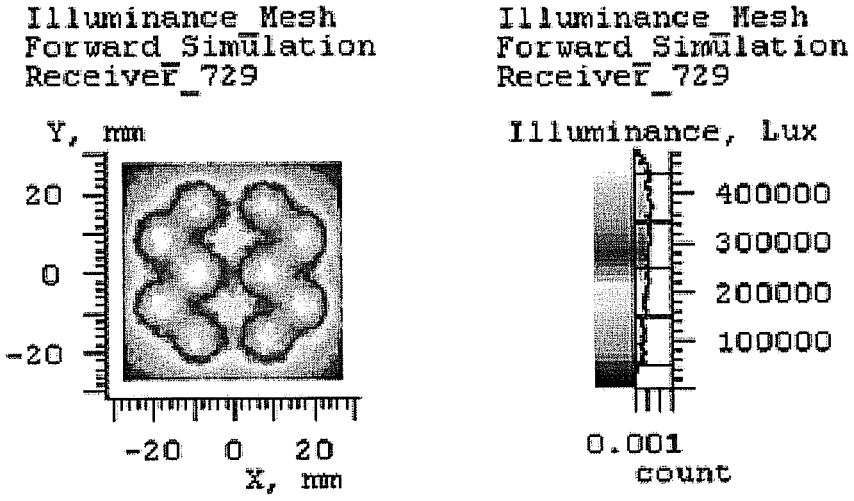

FIGS. 14*a* to 14*c* show data resulting from a second experiment.

The second experiment adds the optic sheet 150 diffusing light to the first experiment shown in FIGS. 13*a* and 13*b*.

FIG. 14*b* is a graph showing a luminous intensity of the second experiment.

Referring to FIG. 14*b*, it is understood that the orientation angle of the light emitted from the lighting apparatus of the second experiment is about 30° and the light also converges in a vertical direction (i.e., 0°).

FIG. 14*c* is a graph showing an illuminance of the second experiment.

Referring to FIG. 14*c*, it is understood that ten dots are uniformly distributed on an irradiated area due to the properties of the distribution of ten LEDs and is understood that dots located at the outermost circumference form a circle. It can be found that the illuminance of the center of each dot reaches 500,000 LUX. Comparing the second experiment with the first experiment, since the optic sheet 150 diffusing light is added to the second experiment, it can be found that light is diffused more in the second experiment than in the first experiment.

As a result of the second experiment shown in FIGS. 14*a* to 14*c*, the efficiency of the lighting apparatus of the second experiment is about 75%. It can be found that the efficiency of the second experiment is lower than that of the first experiment.

Figure 15A:
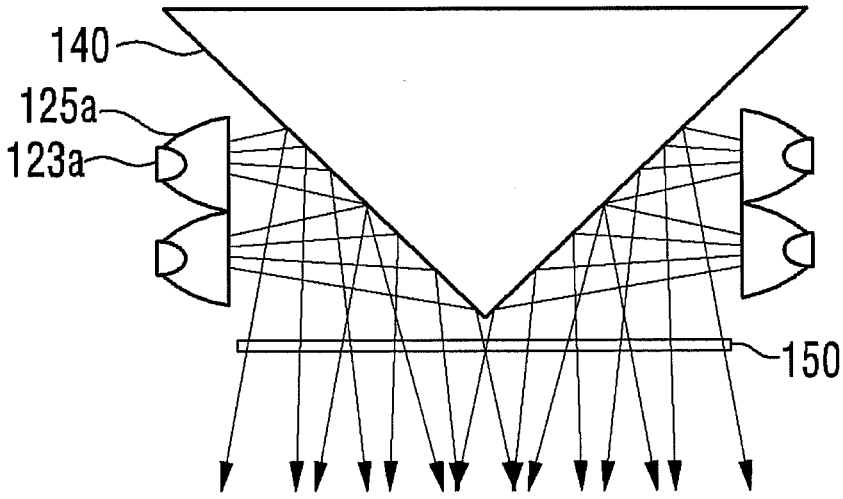
FIGS. 15*a* to 15*c* show data resulting from a third experiment.
Figure 15B:
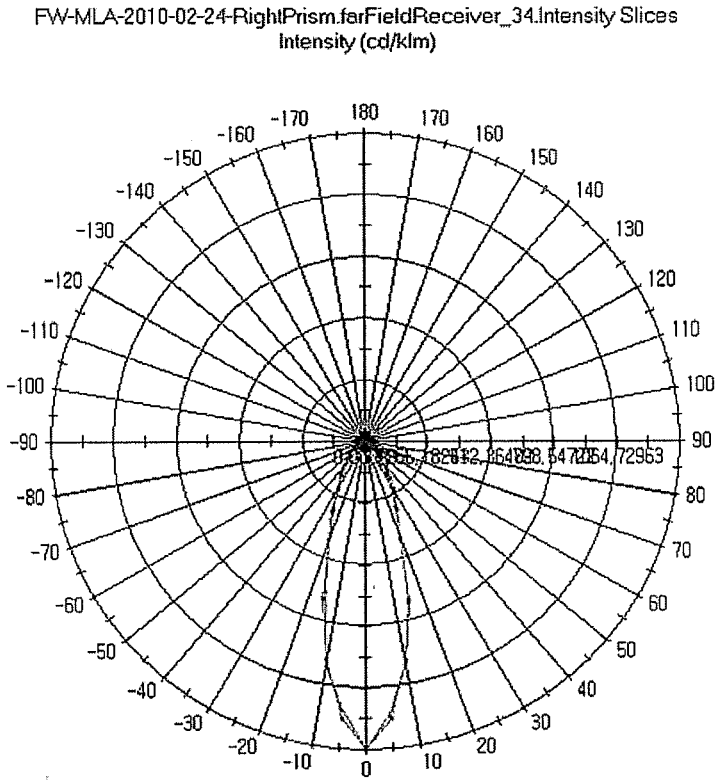
Figure 15C:
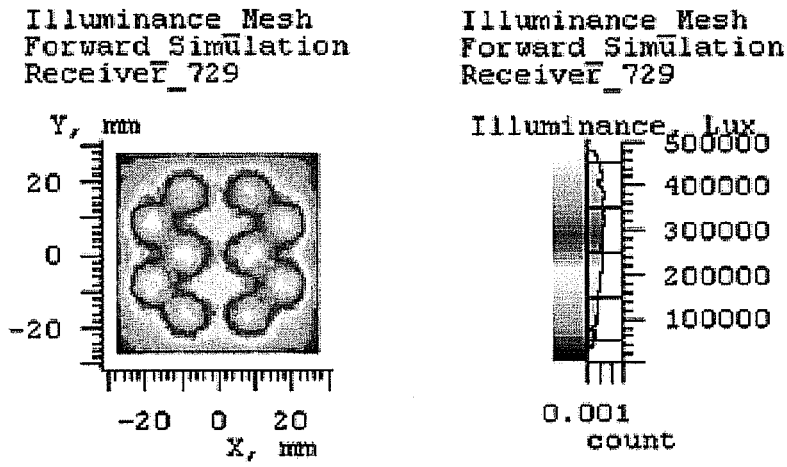

FIGS. 15*a* to 15*c* show data resulting from a third experiment.

The third experiment adds the optic sheet 150 converging light to the first experiment shown in FIGS. 13*a* and 13*b*.

FIG. 15*b* is a graph showing a luminous intensity of the third experiment.

Referring to FIG. 15*b*, it is understood that the orientation angle of the light emitted from the lighting apparatus of the third experiment is about 30° and the light also converges in a vertical direction (i.e., 0°).

FIG. 15*c* is a graph showing an illuminance of the third experiment. Referring to FIG. 15*c*, it is understood that ten dots are uniformly distributed on an irradiated area due to the properties of the distribution of ten LEDs and is understood that dots located at the outermost circumference form a circle. It can be found that the illuminance of the center of each dot reaches 500,000 LUX. Since the optic sheet 150 is added to the third experiment, it can be found that light is converged more in the third experiment than in the second experiment.

As a result of the third experiment shown in FIGS. 15*a* to 15*c*, the efficiency of the lighting apparatus of the third experiment is about 71%. It can be found that the efficiency of the third experiment is lower than that of the first experiment.

Figure 16A:
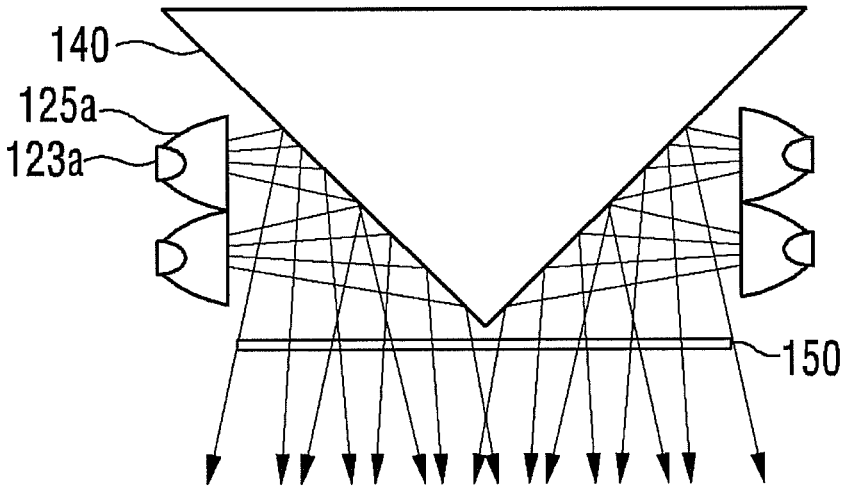
FIGS. 16*a* to 16*c* show data resulting from a fourth experiment.
Figure 16B:
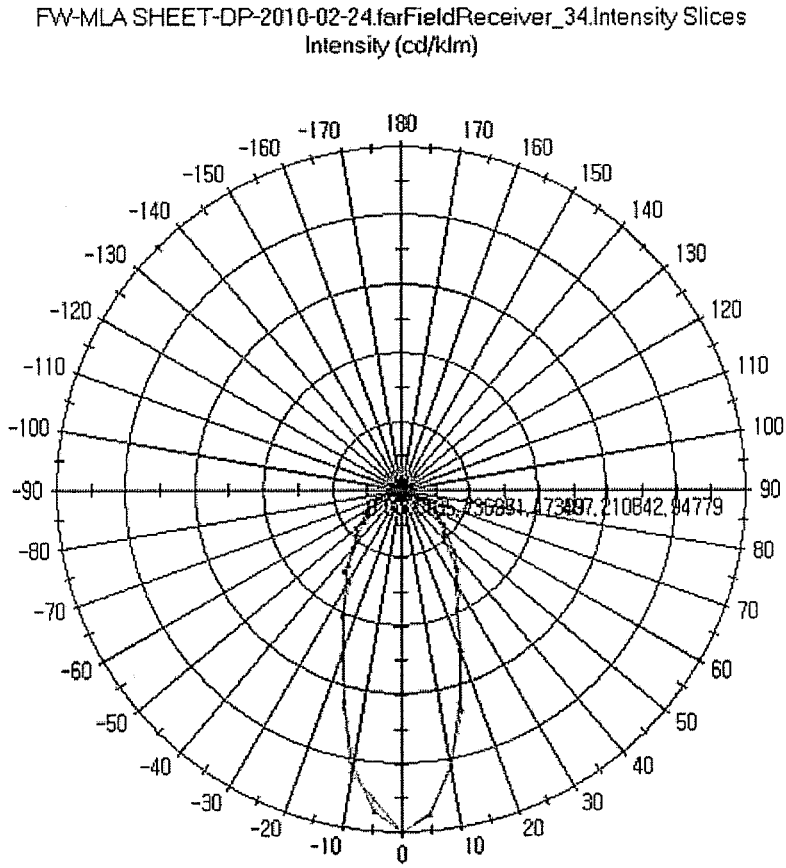
Figure 16C:
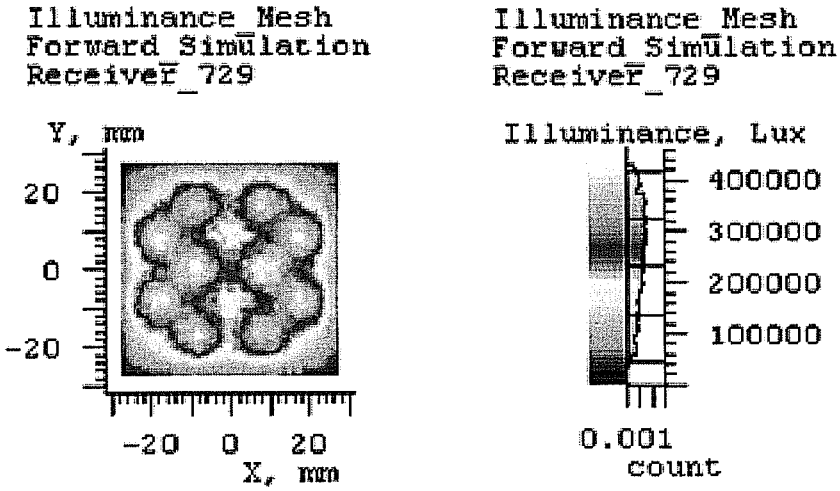

FIGS. 16*a* to 16*c* show data resulting from a fourth experiment.

The fourth experiment adds the optic plate 160 equipped with the glass plate 165 having a diffusing function to the first experiment shown in FIGS. 13*a* and 13*b*.

FIG. 16*b* is a graph showing a luminous intensity of the fourth experiment.

Referring to FIG. 16*b*, it is understood that the orientation angle of the light emitted from the lighting apparatus of the fourth experiment is about 30° and the light also converges in a vertical direction (i.e., 0°).

FIG. 16*c* is a graph showing an illuminance of the fourth experiment.

Referring to FIG. 16*c*, it is understood that ten dots are uniformly distributed on an irradiated area due to the properties of the distribution of ten LEDs and is understood that dots located at the outermost circumference form a circle. It can be found that the illuminance of the center of each dot reaches 450,000 LUX. Since the glass plate 165 having a diffusing function is added to the fourth experiment, it can be found that light is diffused more in the fourth experiment than in the first experiment.

As a result of the fourth experiment shown in FIGS. 16*a* to 16*c*, the efficiency of the lighting apparatus of the fourth experiment is about 70%. It can be found that the efficiency of the fourth experiment is lower than that of the first experiment.

The features, structures and effects and the like described in the embodiments are included in at least one embodiment of the present invention and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present invention.

Although embodiments of the present invention were described above, theses are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A lighting apparatus comprising:

a body including a recess that is defined by an inner wall;

a reflector disposed within the recess of the body and that faces the inner wall of the body, and the reflector includes a reflective surface to reflect light to outside of the recess of the body;

a connecting member coupled to the body;

a light source disposed within the recess of the body and that emits light toward the reflective surface of the reflector, wherein the light source includes a substrate disposed on the inner wall of the body and a light emitting device disposed on the substrate, a fixing plate disposed on the substrate and having a hole through which the light emitting device passes; and a screw that penetrates the fixing plate and the substrate and is coupled to the inner wall of the body, wherein the body has a first opening through which the light reflected by the reflective surface of the reflector passes, and wherein the connecting member has a second opening formed generally coaxial with the first opening of the body, and a diameter of the second opening of the connecting member is less than a diameter of the first opening of the body.

2. The lighting apparatus of claim 1, further comprising a reflection cover coupled to the connecting member and that converges light emitted through the opening of the body.

3. The lighting apparatus of claim 2, further comprising an optic sheet disposed in the opening of the body.

4. The lighting apparatus of claim 3, wherein the connecting member comprises a first frame and a second frame, wherein the first frame surrounds the optic plate, wherein the second frame is extended to an inner end of the first frame, and wherein the optic plate is seated to the second frame.

5. The lighting apparatus of claim 3, wherein the optic plate comprises a glass plate, a first frame, and a second frame, wherein the first frame surrounds the glass plate, wherein the second frame is extended to an inner end of the first frame, and wherein the glass plate is seated to the second frame.

6. The lighting apparatus of claim 1, wherein the fixing plate includes a projection projecting toward the reflective surface of the reflector, and wherein the reflector includes a locking part coupled to the projection of the fixing plate.

7. The lighting apparatus of claim 6, wherein the reflection cover comprises a frame and a cover, wherein the frame surrounds the connecting member, and wherein the cover is coupled to the frame and has an empty cylindrical shape.

8. The lighting apparatus of claim 7, wherein the cover has a top opening and a bottom opening, and wherein a diameter of the top opening is less than a diameter of the bottom opening.

9. A lighting apparatus comprising:

a heat radiating body that includes a first body having a first recess, and a second body having a second recess;

a first substrate disposed in the first recess of the heat radiating body, and that includes a first light emitting device disposed therein;

a second substrate disposed in the second recess of the heat radiating body, and that includes a second light emitting device disposed therein;

a reflector disposed within the first recess and the second recess of the heat radiating body, and that includes a first reflective surface reflecting light emitted from the first light emitting device of the first substrate to outside of the first recess, and a second reflective surface reflecting light emitted from the second light emitting device of the second substrate to outside of the second recess, and is disposed within the first recess and the second recess;

a first fixing plate disposed on the first substrate, and the first fixing plate includes a hole through which the first light emitting device passes; and a screw to penetrate the first fixing plate and the first substrate and then is coupled to the heat radiating body, wherein the first body and the second body of the heat radiating body are coupled to each other to have a first shape, wherein the first recess and the second recess of the heat radiating body are coupled to each other to have a second shape different from the first shape, and wherein the first fixing plate includes a projection to project toward the first reflective surface of the reflector, and wherein the reflector includes a locking part coupled to the projection of the first fixing plate.

10. The lighting apparatus of claim 9, wherein the first substrate comprises a projection extending toward the first fixing plate, and wherein the projection of the first substrate is inserted into a recess formed in a back side of the projection of the first fixing plate.

11. The lighting apparatus of claim 9, further comprising:

a connecting member disposed on the first recess and the second recess of the heat radiating body, and the connecting member includes an opening through which the light reflected by the first and the second reflective surfaces of the reflector passes, and the connecting member is coupled to the heat radiating body; and a reflection cover coupled to the connecting member and that converges light emitted through the opening of the connecting member.

12. The lighting apparatus of claim 9, wherein at least one portion of the first reflective surface of the reflector contacts at least one portion of the second reflective surface of the reflector, wherein the first substrate is disposed opposite to the first reflective surface, and wherein the second substrate is disposed opposite to the second reflective surface.

13. The lighting apparatus of claim 12, further comprising:

a first fixing plate disposed between the first reflective surface and the first substrate, and a second fixing plate disposed between the second reflective surface and the second substrate, wherein the first fixing plate includes a first projection and a first hole through which the first light emitting device of the first substrate passes, and wherein the second fixing plate includes a second projection and a second hole through which the second light emitting device of the second substrate passes.

14. A lighting apparatus comprising:

a body including a recess that is defined by an inner wall;

a reflector disposed within the recess of the body and that faces the inner wall of the body, and the reflector includes a reflective surface to reflect light to outside of the recess of the body;

a connecting member coupled to the body;

a light source disposed within the recess of the body and that emits light toward the reflective surface of the reflector, and a fixing plate disposed on the light source, wherein the light source includes a substrate disposed on the inner wall of the body and a light emitting device disposed on the substrate, wherein the body has a first opening through which the light reflected by the reflective surface of the reflector passes, wherein the connecting member has a second opening formed generally coaxial with the first opening of the body, and a diameter of the second opening of the connecting member is less than a diameter of the first opening of the body, wherein the fixing plate includes a projection projecting toward the reflective surface of the reflector, wherein the reflector includes a locking part coupled to the projection of the fixing plate, and wherein the locking part of the reflector is recess.

15. The lighting apparatus of claim 14, wherein the fixing plate has a hole through which the light emitting device passes.

16. A lighting apparatus comprising:

a heat radiating body including a recess having a first shape, and an external appearance of the heat radiating body having a second shape;

a reflector disposed in the recess of the heat radiating body and that includes both a reflective surface reflecting light to outside of the recess of the heat radiating body and having a third shape;

a light source disposed in the recess of the heat radiating body and that emits light to the reflective surface of the reflector; and a fixing plate disposed between the reflector and the light source, wherein the second shape is different from the first shape, and wherein the third shape is different from the first shape, wherein the fixing plate includes a projection and has a hole through which the light emitted from the light source passes, and wherein the reflector has a recess into which the projection of the fixing plate is provided.

17. The lighting apparatus of claim 16, wherein the light source comprises a substrate disposed on a first surface of the heat radiating body, and a light emitting device disposed on the substrate, and wherein the fixing plate is disposed on the substrate of the light source, the light emitting device passes through the hole, and the projection projects toward the reflective surface of the reflector.

18. The lighting apparatus of claim 16, further comprising a screw that penetrates the fixing plate and the substrate, and is coupled to the first surface of the heat radiating body.

19. The lighting apparatus of claim 16, further comprising:

a connecting member disposed on the recess of the heat radiating body, and the connecting member including an opening through which the light reflected by the reflective surface of the reflector passes, and the connecting member is coupled to the heat radiating body; and a reflection cover coupled to the connecting member, and the reflection cover to converge light emitted through the opening of the connecting member.

20. The lighting apparatus of claim 16, wherein the first shape is a hexahedral shape having a first area with at least one open portion, wherein the second shape is a cylindrical shape, wherein the third shape includes a first surface and a second surface that form the reflective surface, wherein at least one corner of the first surface contacts at least one corner of the second surface, wherein the light source is disposed on one side of the first shape, which corresponds to the first surface, and wherein light reflected by the second surface is emitted through the open first area.

* * * * *